US005394801A

United States Patent [19]

Faber et al.

[11] Patent Number: 5,394,801

[45] Date of Patent: Mar. 7, 1995

[54] FUSE HEAD

[75] Inventors: Gunther Faber, Siegburg; Hans Florin, Troisdorf, both of Germany

[73] Assignee: Dynamit Nobel Aktiengesellschaft, Troisdorf, Germany

[21] Appl. No.: 143,146

[22] Filed: Oct. 29, 1993

[30] Foreign Application Priority Data

Oct. 30, 1992 [DE] Germany ..... 42 36 729.8

[51] Int. Cl.[6] ..... F42C 19/12

[52] U.S. Cl. ..... 102/202.11; 102/202.7

[58] Field of Search ..... 102/202.5, 202.7, 202.9, 102/202.11, 202.12, 202.14

[56] References Cited

U.S. PATENT DOCUMENTS

| | | | |
|---|---|---|---|
| 722,913 | 3/1903 | Schmitt | 102/202.11 |
| 1,532,125 | 4/1925 | Djidics | 102/202.11 |
| 1,736,398 | 11/1929 | Glossl | 102/202.11 |
| 2,481,696 | 9/1949 | Seavey . | |
| 2,506,157 | 5/1950 | Loret . | |
| 2,995,086 | 8/1961 | Scott | 102/202.11 |
| 3,415,189 | 12/1968 | Trevorrow | 102/202.11 |
| 3,447,416 | 6/1969 | Apstein | 102/202.11 |
| 4,152,988 | 5/1979 | Haas, et al. . | |

FOREIGN PATENT DOCUMENTS

| | | |
|---|---|---|
| 331163 | 8/1976 | Austria . |
| 1596121 | 7/1970 | France . |

*Primary Examiner*—Harold J. Tudor

*Attorney, Agent, or Firm*—Antonelli, Terry, Stout & Kraus

[57] ABSTRACT

One fuse head has an insulating pole body with electrically conducting longitudinal strips, an incandescence bridge arranged on the pole body between the strips and connecting wires. The glow bridge and the connecting wires each being connected via soldered joints to the longitudinal strips. The fuse head also has at least one priming explosive and an external varnish finish coating covering the at least one priming explosive. To improve adherence, to facilitate the manufacturing process, to reduce the size of the solder joints, and to reduce the weight distribution of the priming explosive, it is proposed to arrange on the pole body, perpendicular to the pole body axis, grooves which are filled with priming explosive. Another fuse head has a basic module with electrically conducting pole supports running through it, the ends of the supports being connected on the ignition side via an incandescence bridge. It is proposed to arrange on the basic module at least one groove perpendicular to a longitudinal axis of the basic module, said at least one groove being filled with priming explosive.

12 Claims, 2 Drawing Sheets

FUSE HEAD

BACKGROUND OF THE INVENTION

This invention relates to a fuse head, wherein the adherence of the priming explosive to the basic module containing conductive electrodes is enhanced.

Primer caps are generally considered as detonating means that produce a pressure shock which ignites a downstream explosive charge. Ignition caps, the other hand, produce a flame which is then used for ignition of a propellant charge. Since primer caps and ignition caps are substantially identical in construction and differ primarily in the choice of priming explosives, in order to simplify the description of the invention, reference has been made to Fuse Heads.

On pages 28 and 29 of the brochure entitled "Military Initiation Devices", produced in 1988 by Dynamit Nobel AG, Kaiserstr. 1, 5210 Troisdorf, Germany, there is shown a fuse head consisting of a basic module which has electrical connecting wires running through it, and an insulating pole body which is arranged on the basic module. The pole body has a rectangular cross-section, and both its broad faces are covered with copper. An incandescence bridge is applied to the pole body, and each of the ends of said bridge is connected to one of the copper coatings via a soldered joint. At the end of the pole body nearest to the basic module, each of the connecting wires is likewise soldered on both broad faces to the covering of copper. The priming explosive comprises a first and a second priming explosive, which are applied in a bath in a plurality of dipping operations. The first priming explosive is so arranged that it surrounds the incandescence bridge. The second priming explosive forms the outer envelope and is coated with a varnish film for protection.

U.S. Pat. No. 4,152,988 describes a comparable design, though without a pole body. Instead, electrically conductive pole supports run through a basic module, and on the ignition side their ends are connected direct to an incandescence bridge. The incandescence bridge is surrounded by a priming explosive. The priming explosive is again protected externally by a film of varnish.

Both these designs for detonators or fuse heads have the drawback that in hostile ambient conditions as a result of shocks, impacts, vibrations and rotations, the adherence of the priming explosive (or first and second priming explosives) to the basic module is insufficient, and this can cause the detonator to fail.

SUMMARY OF THE INVENTION

It is the object of the invention to provide a fuse head wherein the adherence of the priming explosive to the module is substantially enhanced. A further object is to simplify the application of the priming explosive(s) in the manufacturing process and to reduce the weight distribution of the priming explosive(s).

In accordance with the invention, in a first embodiment an object of the invention is achieved by disposing on the pole body grooves that run perpendicular to the pole body's axis, and by filling the grooves with priming explosive.

These grooves have the advantage that they increase the surface area available to receive the priming explosive, thereby improving adherence. These grooves furthermore have the advantage that during production when the priming explosive is applied, the position of the grooves makes it possible to immerse the pole body to an exact degree. Another important advantage is the fact that the grooves prevent beads of solder on the pole body from expanding undesirably. The grooves therefore even out and limit the size of the beads of solder, and this reduces the weight distribution of the priming explosive.

If the pole body is rectangular in cross-section, it is advantageous to dispose at least one respective groove at the same level on opposite sides of the pole body. In an alternative embodiment the grooves form a cutout passing around the surface of the pole body.

In one preferred embodiment offering advantages for a fuse head with a first and a second priming explosive, two grooves are provided one above the other, and one is filled with the first priming explosive and the other with the second priming explosive.

One specific advantageous embodiment incorporates a pole body having an upper groove and a lower groove on each of its end faces, with the respective upper and lower grooves situated opposite one another.

In one especially preferred embodiment the pole body is arranged on a basic module through which the connection wires or electrodes are leading. The basic module decisively improves stability.

In a second embodiment wherein a pole body is omitted, an object of the invention is achieved by arranging on a basic module at least one groove running perpendicular to the axis of the basic module and filling the groove with priming explosive. In the case of this embodiment, the connecting conductive wires are replaced by pole supports which run through the basic module. On the ignition side these pole supports are connected via an incandescence bridge.

The groove or grooves in the basic module also improve the adherence of the priming explosive and facilitate the manufacturing process, as already noted in connection with the first embodiment.

In advantageous manner the priming explosive comprises a first and a second priming explosive, and the second priming explosive fills the one or more grooves. The second priming explosive completely surrounds the first priming explosive.

In one particularly useful embodiment in which the basic module has a rectangular cross-section, the two broad faces of the basic module have a groove arranged at the same level. In addition, the pole supports are advantageously lamellae, i.e. they are ribbon-shaped metal electrodes.

Advantageous features of the invention will hereinafter be described, which are applicable to all the embodiments.

Since the shape of the grooves also affects adherence, it is proposed that the grooves be either semicircular, rectangular or triangular in cross-section.

It is also advantageous if the grooves have an equal-sided trapezoidal cross-section, with the longer of the parallel sides being disposed in the pole body or basic module, and the shorter side configuring the groove.

In accordance with the invention, the explosive or explosives is/are applied in a bath in a plurality of individual dipping operations. The grooves make application considerably easier by allowing the depth of immersion to be specified. For this reason it is also advantageous, in the case of two priming explosives (first and second priming explosives), to dispose grooves at different heights of the pole body, depending on the depth of immersion in the immersion bath concerned.

BRIEF DESCRIPTION OF THE DRAWINGS

Various embodiments of the fuse head of the present invention are described in detail with reference to the accompanying drawings, wherein.

DETAILED DESCRIPTION OF THE INVENTION

Figure 1A:
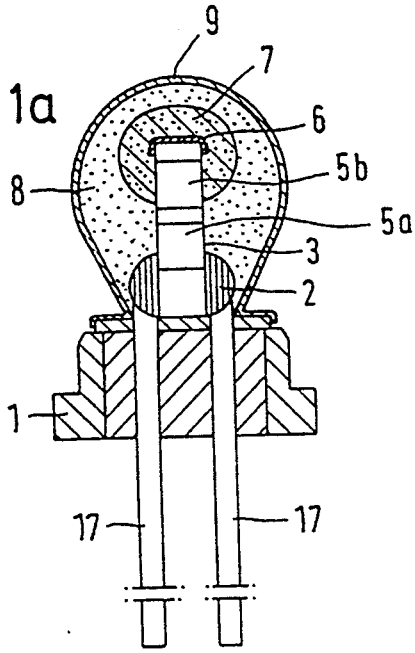
FIGS. 1*a* and 1*b* show a first embodiment of a fuse head in two sections taken through a pole body.
Figure 1B:
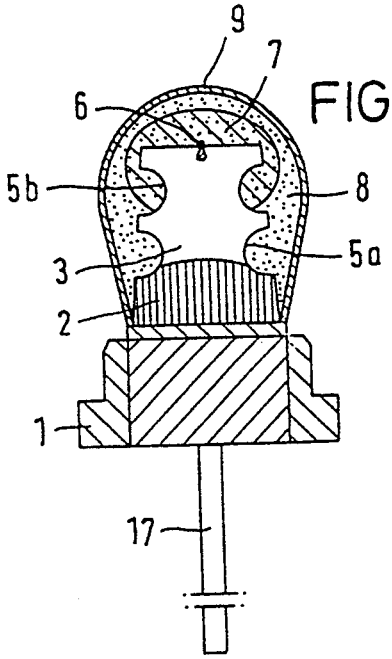

FIGS. 1*a* and 1*b* show front and side sections taken through a first embodiment of a fuse head, respectively, an insulating pole body 3 having a substantially trapezoidal cross-section is placed on an insulating basic module 1 (glass to metal seal), with the longer of the parallel sides resting on the basic module 1. The two broad faces of the pole body 3 (copper coated or laminated insulator) are covered with copper i.e. they are made conductive. On the upper face, i.e. the shorter of the parallel faces, an incandescence bridge, e.g., a thin metal strip or wire 6, is placed which passes over the narrow face of the pole body 3, and the two ends of the incandescence bridge 6 on either side of the pole body 3 are soldered to the copper covering. In addition, solder joints 2 are disposed at the lower end of the pole body 3, or copper covering, and these joints connect the incandescence bridge 6 to connecting wires or electrodes 17 which pass through the basic module 1.

In one particular arrangement it is even possible to omit the basic module.

Two respective grooves 5*a* and 5*b* arranged one above the other and perpendicular to the pole body axis 18 (shown in FIG. 3*a*), are disposed at the same height on each of the two non-parallel narrow faces of the pole body 3. In this embodiment these grooves 5*a* and 5*b* are semicircular in cross-section (also see FIG. 3*a*). In addition a first priming explosive 7 (i.e. lead picrate), and a second priming explosive 8 (i.e. lead picrate and additives), are applied to the pole body 3 by means of an immersion bath in several dipping operations. The first priming explosive 7 completely encloses the upper part of the pole body 3 with the incandescence bridge 6 and extends into the upper groove 5*b*. This greatly improves the adherence of the first priming explosive 7 to the pole body 3. The second priming explosive 8 completely encloses the first priming explosive 7 and fills the groove 5*a* below, i.e. adjoining the basic module. The second priming explosive 8 also surrounds the soldered joints 2 on either side of the pole body 3. Second grooves 5*a* improve the adherence of the second priming explosive 8 to the pole body 3. The grooves 5*a*, 5*b* have the great advantage that when the priming explosives are applied it is easy to determine the depth to which they are immersed, namely such that the priming explosives just fill the associated groove 5*a* or 5*b*. The grooves also limit the spread of the beads of solder at the soldering joints 2. For protection, the second priming explosive 8 and hence all the parts on the ignition side, apart from the basic module 1, are given a varnish finish coating 9. As outlined above, the grooves have the advantage of evening out and limiting the size of the beads of solder, thereby reducing the weight distribution of the priming explosive.

Figure 2A:
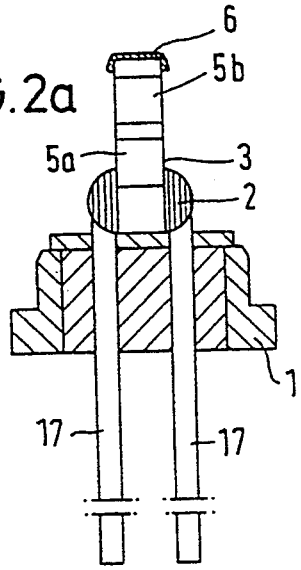
FIGS. 2*a* and 2*b* show the same embodiment as FIG. 1, but without a priming explosive and varnish finish coating.
Figure 2B:
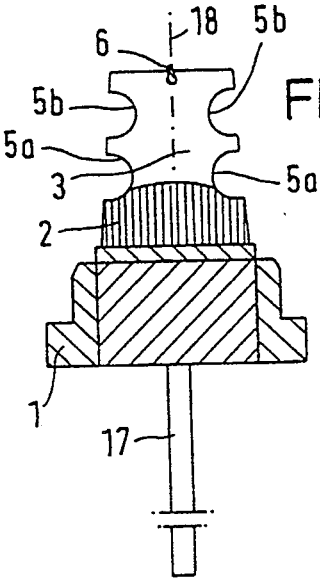

FIGS. 2*a* and 2*b* show the same embodiment as FIGS. 1*a* and 1*b*, but without the priming explosives 7 and 8 and the varnish finish coating 9.

Figure 3A:
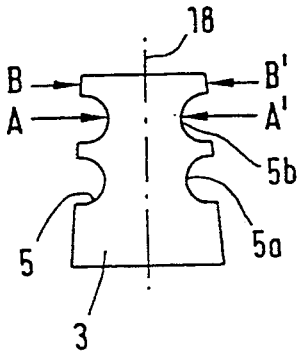
FIG. 3*a* shows a view of a pole body with grooves having a semicircular cross-section.
Figures 3B, 3C, 3D, 3E:
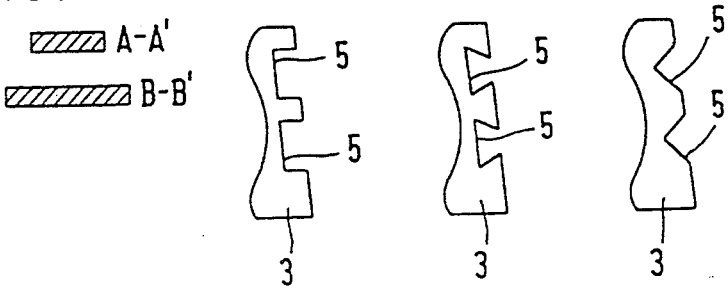
FIG. 3*b* shows sections taken along line A—A' and line B—B' in FIG. 3*a;*
FIG. 3*c* shows grooves having a rectangular cross-section in a pole body.
FIG. 3*d* shows grooves having a trapezoidal cross-section in a pole body.
FIG. 3*e* shows grooves having a triangular cross-section in a pole body.

FIG. 3*a* is a plan view of the broad face of a pole body 3 with grooves 5*a* and 5*b* of semicircular cross-section FIG. 3*b* shows sections taken along line A—A' and line B—B' of FIG. 3*a*, respectively. The pole body 3 shown in FIG. 3*a* is identical to the pole body 3 according to FIGS. 1*a*, 1*b*, 2*a* and 2*b*.

FIG. 3*c* shows a different embodiment of the pole body having grooves 5 of rectangular cross-section; whereas FIG. 3*e* show yet another embodiment of the pole body having grooves 5 of triangular cross-section.

FIG. 3*d* shows an embodiment of the pole body having trapezoidal grooves 5, the grooves 5 having an equal-sided trapezoidal cross-section whereby the longer of the parallel sides is arranged in the pole body 3, while the shorter of the parallel sides configures the opening of the groove. However, other shapes of grooves 5 are also possible and practicable.

Figure 4A:
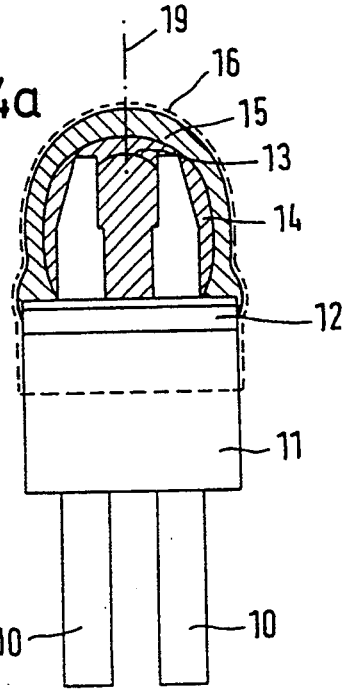
FIGS. 4*a* and 4*b* show a second embodiment of a fuse head in two cross-sections.
Figure 4B:
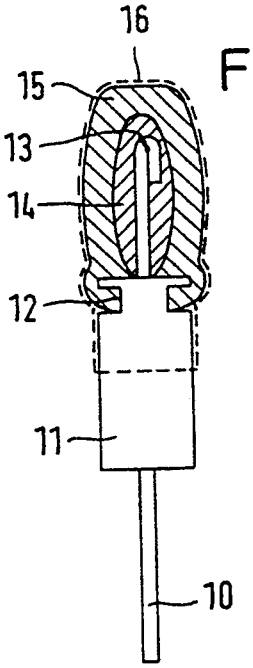
Figure 5A:
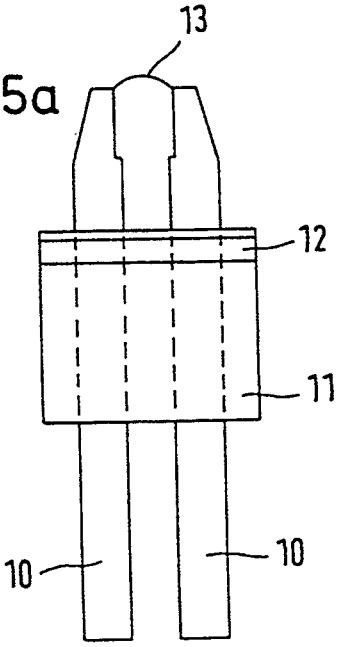
FIGS. 5*a* and 5*b* show the same embodiment as FIG. 4, but without a priming explosive and a varnish finish coating.
Figure 5B:
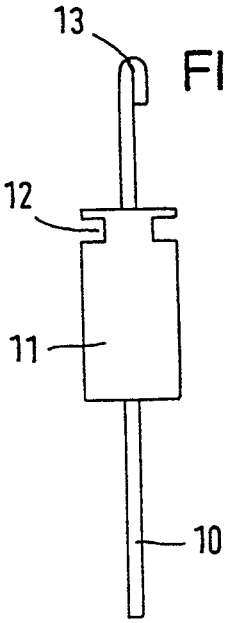

FIGS. 4*a*, 4*b*, 5*a* and 5*b* show a second preferred embodiment of a fuse head. The fuse head in this embodiment consists of a parallelpiped-like basic module 11 which has electrically conducting pole supports or electrodes 10 running through it. These pole supports 10 are in the form of flat strips or lamellae of metal. On the ignition side the ends of the pole support 10 are interconnected via an incandescence bridge 13, e.g., a wire, (see FIGS. 4*a* and 5*a*). For this purpose the ends of the pole supports 10 are bent back and are each wrapped around one end of the incandescence bridge 13. A welded joint additionally provides the electrical contact. In FIGS. 4*b* and 5*b*, an end of the incandescence bridge is merely indicated. Both the pole supports 10 and the incandescence bridge 13 are surrounded by a first priming explosive 14. The first priming explosive 14 is in turn surrounded by a second priming explosive 15, which is arranged around the top end of the basic module 11. At this top end of the basic module 11, grooves 12 which run perpendicular to the basic module's axis 19 are arranged on both broad faces of the basic module 11, and said grooves 12 are filled with the second priming explosive 15. The grooves 12 pass right through the two broad faces.

In this embodiment, too, the priming explosives (first and second priming explosive) are applied in a bath by several dipping operations.

To protect the priming explosives, a varnish finish coating 16 is applied over the second priming explosive 15 and part of the basic module 11.

Each groove 12 greatly improves adherence of the priming explosive 15 in this embodiment and facilitates the manufacturing process.

FIGS. 5*a* and 5*b* show front and side views of the same embodiment as that shown in FIGS. 4*a* and 4*b*, but without the priming explosives 14 and 15 and the varnish finish coating 16.

It will be understood that the terms "the pole body's axis 18" and "the basic module's axis 19" each refer to the axis that runs lengthwise of the fuse head.

What is claimed is:

1. A fuse head which comprises an insulating pole body, electrically conducting longitudinal strips on opposite major surfaces of said pole body, an incandescence bridge of conductive material arranged on an end portion of the pole body, connecting electrodes, said incandescence bridge and said connecting electrodes being, respectively, connected to the longitudinal strips via soldered joints, and a first priming explosive arranged over the bridge and over portions of the longitudinal strips, a second priming explosive covering the first priming explosive and other portions of said longitudinal strips, and an external varnish finish coating covering the second priming explosive; said pole body having grooves arranged to run perpendicular to a longitudinal axis of the pole body and said grooves being filled with the second priming explosive.

2. A fuse head according to claim 1, wherein the pole body has a rectangular cross-section and at least one groove is arranged on opposite sides of the pole body at the same height.

3. A fuse head according to claim 1, wherein the pole body is arranged on a basic insulating module through which the connecting electrodes extend.

4. A fuse head according to claim 1, wherein the grooves have a rectangular cross-section.

5. A fuse head according to claim 1, wherein the grooves have a triangular cross-section.

6. A fuse head according to claim 1, wherein the grooves have an equal-sided trapezoidal cross-section, the longer of the parallel sides being arranged in the pole body, and the shorter side configuring the groove.

7. A fuse head which comprises an insulating pole body, electrically conducting longitudinal strips on opposite major surfaces of said pole body, an incandescence bridge of conductive material arranged on the pole body, connecting electrodes, said incandescence bridge and said connecting electrodes being, respectively, connected to the longitudinal strips via soldered joints, and at least one priming explosive arranged over the bridge and an external varnish finish coating covering the at least one priming explosive; said pole body having two grooves arranged to run perpendicular to a longitudinal axis of the pole body and said two grooves being provided one above the other, one of the grooves being filled with a first priming explosive and the other being filled with a second priming explosive.

8. A fuse head which comprises an insulating pole body, electrically conducting longitudinal strips on opposite major surfaces of said pole body, an incandescence bridge of conductive material arranged on the pole body, connecting electrodes, said incandescence bridge and said connecting electrodes being, respectively, connected to the longitudinal strips via soldered joints, and at least one priming explosive arranged over the bridge and an external varnish finish coating covering the at least one priming explosive; said pole body having grooves arranged to run perpendicular to a longitudinal axis of the pole body; the pole body having a rectangular cross-section and at least one groove being arranged on opposite sides of the pole body at the same height and two grooves being provided one above the other, one of the two grooves being filled with a first priming explosive and the other being filled with a second priming explosive.

9. A fuse head which comprises an insulating pole body, electrically conducting longitudinal strips on opposite major surfaces of said pole body, an incandescence bridge of conductive material arranged on the pole body, connecting electrodes, said incandescence bridge and said connecting electrodes being, respectively, connected to the longitudinal strips via soldered joints, and at least one priming explosive arranged over the bridge and an external varnish finish coating covering the at least one priming explosive; said pole body having grooves arranged to run perpendicular to a longitudinal axis of the pole body and said grooves being filled with at least one priming explosive; the grooves having a semicircular cross-section.

10. A fuse head which comprises an insulating pole body, electrically conducting longitudinal strips on opposite major surfaces of said pole body, an incandescence bridge of conductive material arranged on the pole body, connecting electrodes, said incandescence bridge and said connecting electrodes, respectively, being connected to the longitudinal strips; a first priming explosive arranged over the bridge and over portions of the longitudinal strips and a second priming explosive arranged over the first priming explosive and over other portions of the longitudinal strips; said pole body having two grooves arranged to run perpendicular to a longitudinal axis of the pole body, one groove being filled with the first priming explosive and the other groove being filled with the second priming explosive.

11. A fuse head according to claim 10, wherein the two grooves are provided one above the other.

12. A fuse head according to claim 10, further comprising a basic insulating module through which the connecting electrodes extend and on which the pole body is arranged.

* * * * *